US009540866B2

(12) United States Patent
Yi

(10) Patent No.: US 9,540,866 B2
(45) Date of Patent: Jan. 10, 2017

(54) SECURITY WINDOW APPLIED TO SINGLE WINDOW

(71) Applicant: Na Hyong Yi, Gyeonggi-do (KR)

(72) Inventor: Na Hyong Yi, Gyeonggi-do (KR)

( * ) Notice: Subject to any disclaimer, the term of this patent is extended or adjusted under 35 U.S.C. 154(b) by 0 days.

(21) Appl. No.: 14/424,546

(22) PCT Filed: Aug. 30, 2013

(86) PCT No.: PCT/KR2013/007797

§ 371 (c)(1),
(2) Date: Feb. 27, 2015

(87) PCT Pub. No.: WO2014/035174

PCT Pub. Date: Mar. 6, 2014

(65) Prior Publication Data

US 2015/0259972 A1 Sep. 17, 2015

(30) Foreign Application Priority Data

Aug. 30, 2012 (KR) ..... 10-2012-0095330
Aug. 28, 2013 (KR) ..... 10-2013-0102071

(51) Int. Cl.

| | |
|---|---|
| ***E06B 3/92*** | (2006.01) |
| ***E06B 9/06*** | (2006.01) |
| ***E05B 53/00*** | (2006.01) |
| ***E05B 65/10*** | (2006.01) |
| ***E05C 9/02*** | (2006.01) |

(Continued)

(52) U.S. Cl.

CPC ..... *E06B 9/0623* (2013.01); *E05B 9/082* (2013.01); *E05B 13/002* (2013.01); *E05B 53/003* (2013.01); *E05B 65/1033* (2013.01); *E05C 9/02* (2013.01); *E05C 19/006* (2013.01); *E06B 9/0661* (2013.01); *E05C 2009/1866* (2013.01)

(58) Field of Classification Search

CPC ..... E05B 65/1033; E05B 9/01; E05B 9/02; E05B 9/06; E05B 2009/002; E05B 9/0623; E05B 9/0661; E05B 9/0607; E05B 9/063; E05C 9/02; E05C 2009/1866

USPC ..... 160/159, 136, 138, 139, 160, 102, 107,160/152, 103, 104, 99, 100

See application file for complete search history.

(56) References Cited

U.S. PATENT DOCUMENTS 993,654 A * 5/1911 Conant ..... E06B 9/01 160/102
1,067,267 A * 7/1913 Newpher ..... E06B 9/0623 160/160

(Continued)

FOREIGN PATENT DOCUMENTS

KR 202000005362 3/2000
KR 200333141 11/2003

(Continued)

*Primary Examiner* — Katherine Mitchell
*Assistant Examiner* — Johnnie A Shablack
(74) *Attorney, Agent, or Firm* — IPLA P.A.; James E. Bame

(57) ABSTRACT

A security window applied to a single window is applied to a previously installed single window so as to block an open space of the window and prevent entry by strangers and a person inside from having a falling accident. The security window can be separated from within a room as necessary, and thus movement of an object or emergency escape is facilitated. Meanwhile, the security window cannot be separated from outside the room, and thus intrusion by persons with malicious intent can be prevented from the onset.

3 Claims, 12 Drawing Sheets

(51) Int. Cl.

| | |
|---|---|
| ***E05C 19/00*** | (2006.01) |
| ***E05B 9/08*** | (2006.01) |
| ***E05B 13/00*** | (2006.01) |
| *E05C 9/18* | (2006.01) |

(56) References Cited

U.S. PATENT DOCUMENTS 1,143,588 A * 6/1915 Quornick ..... E06B 9/01 160/102
1,323,657 A * 12/1919 Swanson ..... E06B 9/0623 160/160
1,471,477 A * 10/1923 Duffy ..... E06B 9/0623 160/107
1,501,545 A * 7/1924 Piffard-Francis ..... E06B 9/01 160/104
1,502,833 A * 7/1924 Kitzelman ..... E06B 9/0623 160/160
1,810,847 A * 6/1931 Nordell ..... E06B 3/94 160/159
1,877,829 A * 9/1932 Erlinder ..... E06B 3/94 160/159
1,878,034 A * 9/1932 Vansant ..... E06B 3/94 160/118
1,907,021 A * 5/1933 Vansant ..... E06B 3/94 160/159
1,908,919 A * 5/1933 Reed ..... E06B 9/01 160/102
2,001,181 A * 5/1935 Burcham ..... E06B 9/01 160/159
2,179,042 A * 11/1939 Jackson ..... G08B 13/08 160/160
2,422,840 A * 6/1947 Mayer ..... E06B 9/01 160/102
2,512,594 A * 6/1950 Burnes ..... E06B 9/368 160/151
2,662,242 A * 12/1953 Hess ..... A47G 5/00 16/257
3,074,475 A * 1/1963 McPhaden ..... E06B 9/0623 160/160
3,182,351 A * 5/1965 Kaufman ..... E05D 11/1014 16/235
3,417,805 A * 12/1968 Kaufman ..... E06B 9/0623 160/152
3,506,056 A * 4/1970 Quinones ..... E06B 9/0623 160/160
3,885,616 A * 5/1975 Berkowitz ..... E06B 9/0623 160/215
3,953,064 A * 4/1976 McHenry ..... E05C 1/10 292/153
4,006,768 A * 2/1977 Horgan, Jr. ..... E06B 9/0661 160/136
4,384,436 A * 5/1983 Green ..... E06B 9/01 49/61
4,575,965 A * 3/1986 Iversen ..... E06B 9/04 49/50
4,796,384 A * 1/1989 Warwick ..... E06B 9/01 292/302
4,816,310 A * 3/1989 Truyens ..... A47B 43/00 160/136
4,879,842 A * 11/1989 Bailey ..... E05B 65/1033 49/141
4,897,961 A * 2/1990 Shine ..... E05B 63/127 49/141
4,937,975 A * 7/1990 Zilkha ..... E05C 9/02 292/143
5,012,610 A * 5/1991 Carballo ..... E06B 7/086 49/141
5,018,302 A * 5/1991 Kluge ..... E05B 65/1033 292/304
5,020,834 A * 6/1991 Zilkha ..... E05B 65/1033 292/189
5,174,063 A * 12/1992 Lewis ..... E05B 65/1033 49/141
5,437,134 A * 8/1995 Donnelly ..... E06B 9/0623 160/161
5,535,803 A * 7/1996 Pretorius ..... E06B 9/0661 160/136
5,622,395 A * 4/1997 Shine ..... E05B 53/005 292/125
5,692,551 A * 12/1997 Blunt ..... E06B 9/0661 160/10
5,740,849 A * 4/1998 Tashman ..... E05B 65/087 160/102
6,202,729 B1 * 3/2001 Cunningham ..... E06B 9/0623 160/136
6,405,497 B1 * 6/2002 Christopolous ..... E06B 9/01 49/54
6,412,234 B1 * 7/2002 Leoni ..... E06B 9/063 160/159
RE44,387 E * 7/2013 Bridges ..... E05B 65/0003 220/326
8,534,343 B2 * 9/2013 Yl ..... E06B 9/063 160/102
2007/0227676 A1 * 10/2007 Legay ..... E06B 7/03 160/102
2007/0245631 A1 * 10/2007 Yi ..... E06B 9/063 49/55
2011/0258932 A1 10/2011 Yi
2014/0352219 A1 * 12/2014 Zieske ..... E06B 7/02 49/124
2015/0259972 A1 * 9/2015 Yi ..... E05B 53/003 160/159

FOREIGN PATENT DOCUMENTS

KR 20100136153 12/2010
KR 101062847 9/2011

* cited by examiner

SECURITY WINDOW APPLIED TO SINGLE WINDOW

BACKGROUND

The invention relates to a technology related to security windows that are applied to single windows and prevent unauthorized entry and falls from windows.

Security windows are installed to windows in houses, offices, etc. to prevent unauthorized entry and falls out of the windows.

In general, conventional security widows are fixed to the external window. Once they are fixedly installed to the window, they don't allow objects to pass through, which is a disadvantage. In particular, conventional security windows are disadvantageous in that, since they are fixed to the window, they cause difficulties in the rapid escape of people during a fire and this may lead to the loss of lives.

Since conventional security windows are fixed to the external window with bolts, they may be separated from the window by persons with malicious intent removing the bolts, which means that they cannot prevent unauthorized entry from the beginning.

A conventional technology related to security windows was published in Korean Patent Publication No. 10-2005-0118032.

SUMMARY OF THE INVENTION

The present invention has been made in view of the above problems, and provides a security window applied to a single window that cannot be easily removed from the outside of the building and can be removed from the inside of the building, if necessary.

In accordance with an exemplary embodiment of the present invention, the present invention provides a security window applied to a single window comprising: moving guides fixedly installed between one side of an outside channel's window and a sash at a location facing the outside channel's window; and a lattice unit with a number of vertical rods, wherein: the vertical rods are connected to each other by links, form insertion holes to which the moving guides are inserted, and are collapsed or spread out along the moving guides; one vertical rod at one end of the vertical rods is fixed to the sash facing the outside channel's window; the other vertical rod at the other end of the vertical rods is coupled to an inside channel's window; the vertical rods are spread out along the moving guides when the inside channel's window is open; and the vertical rods are collapsed along the moving guides when the inside channel's window is closed. The vertical rod at the other end of the lattice unit forms one or more coupling holes; the inside channel's window forms coupling protrusions to be inserted into the coupling holes; when the inside channel's window is installed to the sash, the coupling protrusions are inserted into the coupling holes, and the inside channel's window and the lattice unit are coupled to each other.

Preferably, the coupling protrusion of the inside channel's window is shaped to have a portion bent in the lower direction; when the top of the inside channel's window is lifted and inserted in an upper channel of the sash and the bottom is placed on a rail in a lower channel of the sash, the bent portion of the coupling protrusion is locked into the coupling hole of the vertical rod at the other end of the lattice unit, and the inside channel's window and the lattice unit are coupled to each other.

Preferably, the security window may further comprise a lift preventing unit, installed at the top of the inside channel's window, for preventing the inside channel's window from being lifted up from the sash.

In accordance with another exemplary embodiment of the present invention, the present invention provides a security window applied to a single window comprising: moving guides fixedly installed between one side of an outside channel's window and a sash at a location facing the outside channel's window; a lattice unit with a number of vertical rods, wherein: the vertical rods are connected to each other by links, form insertion holes to which the moving guides are inserted, and are collapsed or spread out along the moving guides; one vertical rod at one end of vertical rods is fixed to the sash facing the outside channel's window; and the other vertical rod at the other end of the vertical rods forms coupling protrusions; a fixing bar including a body and a locking piece, wherein: the body is installed to one side of an inside channel's window and forms a coupling hole through which the coupling protrusion passes; and the locking piece connects the top to one end of a pulling wire, is movable up and down, and forms a locking hole at a location corresponding to the coupling hole of the body; and a lock for binding the coupling protrusion of the lattice unit as the locking piece is lifted up by operating a switch connected to the other end of the pulling wire or for unlocking the coupling protrusion by lowering the locking piece.

Preferably, the coupling protrusion of the lattice unit is shaped to have a portion bent in the lower direction; and the locking piece of the fixing bar is shaped to have a portion bent as the letter 'L' in cross-section, wherein: the locking hole facing the coupling hole of the body is formed on one side wall of the bent portion of the locking piece; and when the locking piece is lifted up by operating the lock, the bent portion of the coupling protrusion is bound into the locking hole.

Preferably, the body of the fixing bar is fixed to the inside channel's window by a bolt; a bolt guide hole through which that bolt passes is formed on the other side wall of the bent portion of the locking piece of the fixing bar; when the locking piece is lowered, the bolt guide hole faces the bolt, so that the bolt is loosened; and when the locking piece is lifted, the bolt is hidden, so that the bolt is not loosened.

In accordance with another exemplary embodiment of the present invention, the present invention provides a security window applied to a single window comprising: moving guides extended and installed between both sides of a sash; a lattice unit with a number of vertical rods, wherein: the vertical rods are connected to each other by links, form insertion holes to which the moving guides are inserted, and are collapsed or spread out along the moving guides; one vertical rod at one end of vertical rods is fixed to one side of the sash; and the other vertical rod at the other end of the vertical rods forms coupling protrusions; a fixing bar including a body and a locking piece, wherein: the body is installed to the other end of the sash and forms a coupling hole through which the coupling protrusion of the lattice unit passes; and the locking piece connects the top to one end of a pulling wire, is movable up and down, and forms a locking hole at a location corresponding to the coupling hole of the body; and a lock for binding the coupling protrusion of the lattice unit as the locking piece is lifted up by operating a switch connected to the other end of the pulling wire or for unlocking the coupling protrusion by lowering the locking piece.

In accordance with another exemplary embodiment of the present invention, the present invention provides a security window applied to a single window comprising: a lattice-fixed security window, where one end of the lattice-fixed security is pivotally fixed to one side of a sash and the other form a coupling protrusion; a fixing bar including a body and a locking piece, wherein: the body is installed to the other end of the sash and forms a coupling hole through which the coupling protrusion of the lattice-fixed security window passes; and the locking piece connects the top to one end of a pulling wire, is movable up and down, and forms a locking hole at a location corresponding to the coupling hole of the body; and a lock for binding the coupling protrusion of the lattice-fixed security window as the locking piece is lifted up by operating a switch connected to the other end of the pulling wire or for unlocking the coupling protrusion by lowering the locking piece.

BRIEF DESCRIPTION OF THE DRAWINGS

The features and advantages of the invention will become more apparent from the following detailed description in conjunction with the accompanying drawings, in which.

BRIEF DESCRIPTION OF SYMBOLS IN THE DRAWINGS

Figure 1:
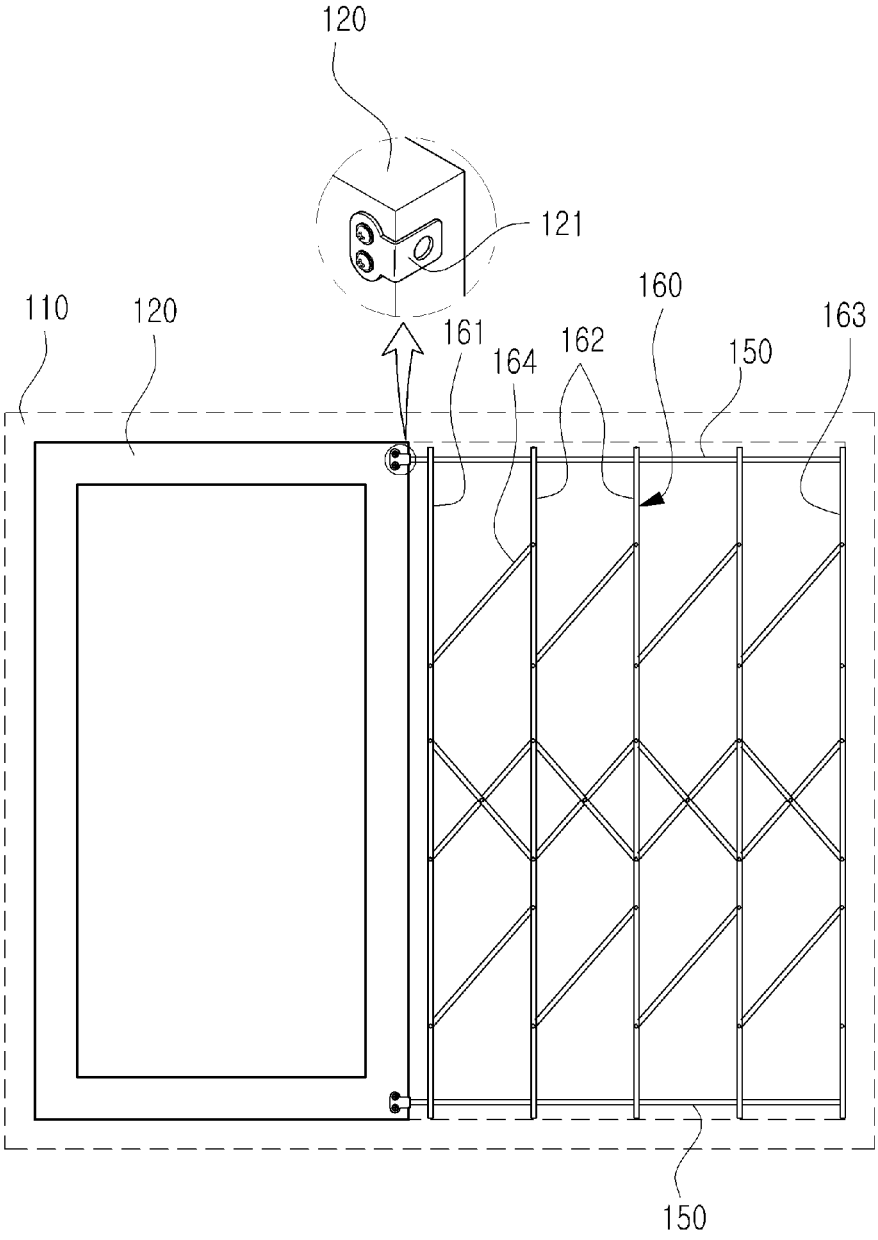
FIG. 1 is an elevation view of a security window applied to a single window, installed to a sash, seen from the inside of the building, in a state where an inside channel's window is removed, according to a first embodiment of the invention.

110: sash
120: outside channel's window
121: moving guide installation piece
130: inside channel's window
131: frame
132: coupling protrusion
133: Insert guide piece
134: lift preventing unit
150: moving guide
160: lattice unit
161: coupling vertical rod
161*a*: insertion hole a
161*b*: coupling hole
162: intermediate vertical rods
163: fixed vertical rod
164: links
210: sash
220: outside channel's window
230: inside channel's window
231: frame
231*a*: through-hole
232: cover
250: moving guide
260: lattice unit
261: coupling vertical rod
261*a*: insertion hole a
261*b*: coupling protrusion
262: intermediate vertical rods
263: fixed vertical rod
264: links
270: pulling wire
280: lock
281: switch
281*a*: locking piece
282: latching protrusion
283: unlatching button
290: fixing bar
291: body

291*a*: coupling hole
291*b*: inserting hole
291*c*: bolt entry portion
291*d*: bolt fixing portion
292: locking piece
292*a*: locking hole
292*b*: bolt guide hole
292*c*: insertion hole a
293: bolt
310: sash
350: moving guide
360: lattice unit
361: coupling vertical rod
361*a*: insertion hole a
361*b*: coupling protrusion
362: intermediate vertical rods
363: fixed vertical rod
364: links
370: pulling wire
380: lock
390: fixing bar
391: body
410: sash
460: lattice-fixed security window
462: coupling protrusion
463: hinge
480: lock
490: fixing bar
491: body

DETAILED DESCRIPTION OF EXEMPLARY EMBODIMENTS

Hereinafter, preferred embodiments of the invention are described in detail with reference to the accompanying drawings. Detailed descriptions of well-known functions and structures incorporated herein may be omitted or briefly explained to avoid obscuring the subject matter of the invention. Therefore, it will be appreciated to those skilled in the art that, although components are not shown in the drawings, they should be considered as part of the invention.

Embodiment 1

Figure 2:
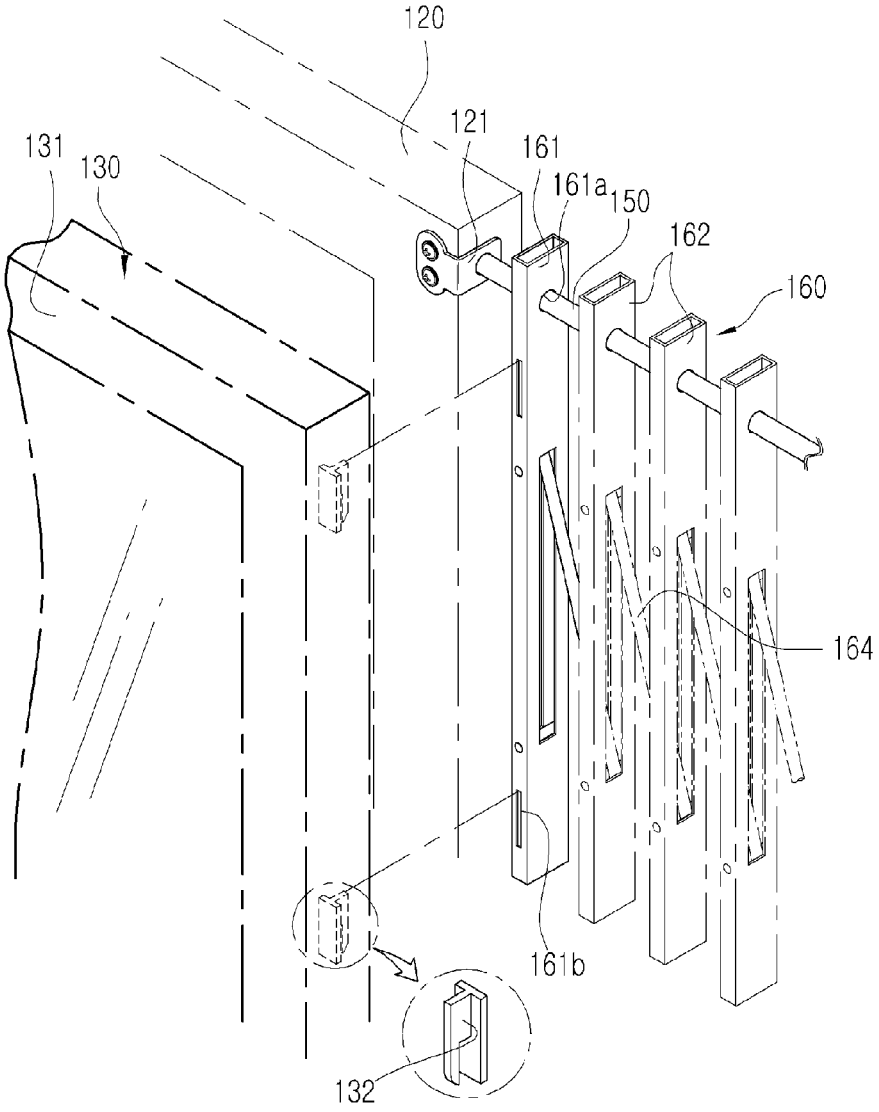
FIG. 2 is a partial perspective view of a security window applied to a single window that describes a lattice unit, moving guide, and coupling protrusion installed to an inside channel's window, according to a first embodiment of the invention.
Figure 3:
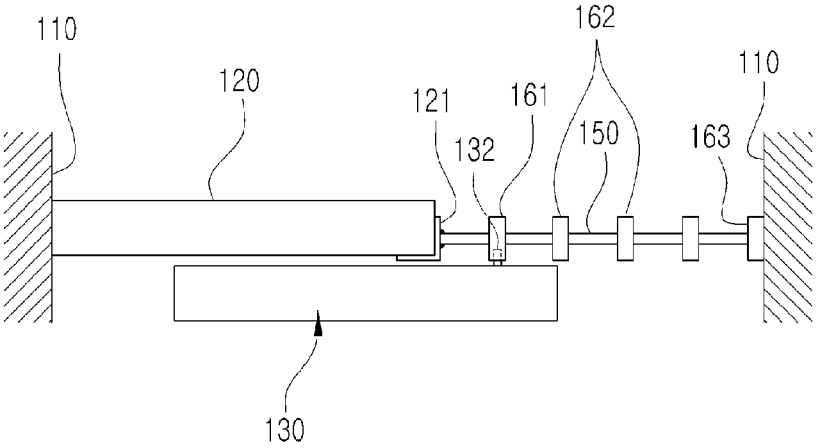
FIG. 3 is a top view of a window to which a security window applied to a single window is installed, in a state where the inside channel's window is open according to a first embodiment of the invention.
Figure 4:
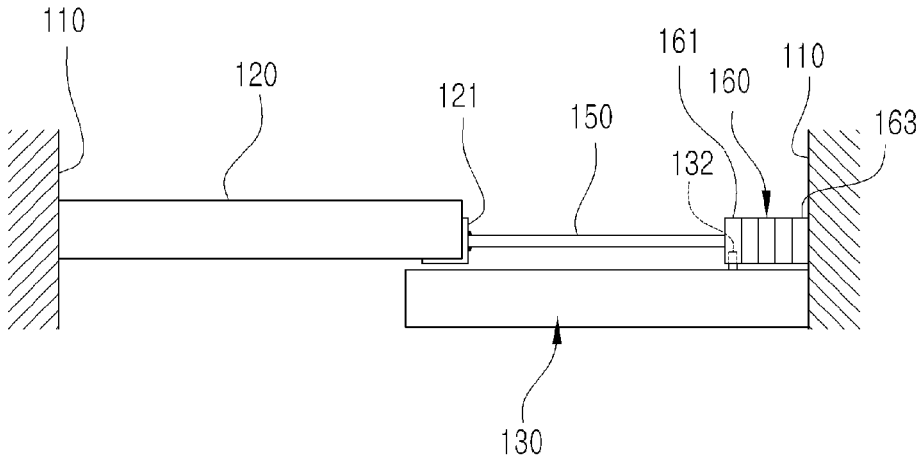
FIG. 4 is a top view of a window to which a security window applied to a single window is installed, in a state where the inside channel's window is closed according to a first embodiment of the invention.
Figure 5:
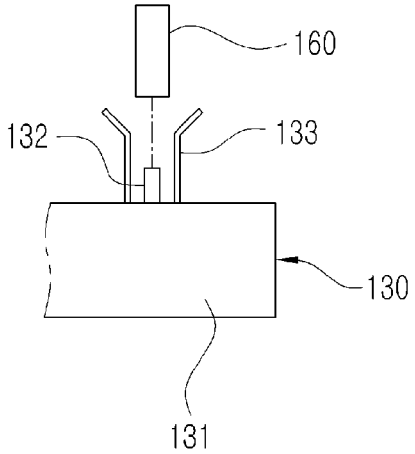
FIG. 5 is an elevation view of a coupling protrusion of an inside channel's window to which an insert guide piece is installed, in a security window applied to a single window according to a first embodiment of the invention.
Figure 6:
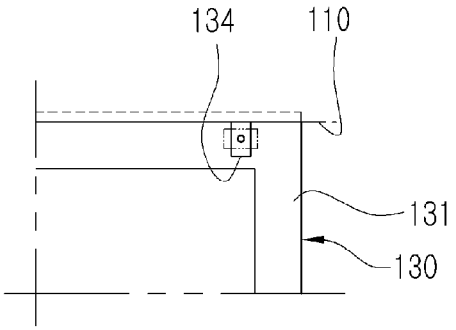
FIG. 6 is an elevation view of an inside channel's window to which a lifting preventing unit is installed, in a security window applied to a single window according to a first embodiment of the invention.

FIG. 1 is an elevation view of a security window applied to a single window (hereafter called a security window), installed to a sash, seen from the inside of the building, in a state where an inside channel's window is removed, according to a first embodiment of the invention. FIG. 2 is a partial perspective view of a security window that describes a lattice unit, moving guide, and coupling protrusion installed to an inside channel's window, according to a first embodiment of the invention. FIG. 3 is a top view of a window to which a security window is installed, in a state where the inside channel's window is open according to a first embodiment of the invention. FIG. 4 is atop view of a window to which a security window is installed, in a state where the inside channel's window is closed according to a first embodiment of the invention. FIG. 5 is an elevation view of a coupling protrusion of an inside channel's window to which an insert guide piece is installed, in a security window according to a first embodiment of the invention. FIG. 6 is an elevation view of an inside channel's window to which a lifting preventing unit is installed, in a security window according to a first embodiment of the invention.

As shown in FIGS. 1 to 4, the security window according to a first embodiment of the invention includes a moving guide and a collapsible lattice unit, and is installed to sashes.

Moving guide installation pieces 121 for supporting the moving guide 150 are fixedly installed at the top and bottom of the one side end.

The lattice unit 160 includes a number of vertical rods 161, 162 and 163 and a number of links 164. In FIG. 1, the vertical rod leftmost is defined as a coupling vertical rod 161 and the vertical rod rightmost is defined as a fixed vertical rod 163. In addition, the vertical rods between the coupling vertical rod 161 and the fixed vertical rod 163 are defined as intermediate vertical rods 162.

The vertical rods 161, 162 and 163 are connected to each other with the links 164. Each link 164 connects two adjacent vertical rods in such a way that one end is pivotally coupled to a location of one vertical rod and the other end is coupled into the other vertical rod, smoothly moving along in the lengthwise direction. Therefore, when vertical rods 161, 162, and 163 are pulled in the horizontal direction, the links 164 are unfolded and spread out in the space between the adjacent vertical rods. Conversely, when vertical rods 161, 162, and 163 are collected, the links 164 are folded.

Each of the vertical rods 162, 162 and 163 of the lattice unit 160 forms insertion holes a 161*a* at the top and bottom portions through which the moving guide 150 is fitted. When the moving guide 150 is fitted through the insertion holes a 161*a*, one end is fixed to the moving guide installation piece 121 of the outside channel's window 120 and the other end is fixed to the sash 110. The coupling vertical rod 161 and the intermediate vertical rods 162 are movable along the moving guide 150. The fixed vertical rod 163 is fixed to the sash 110 so that it cannot be moved.

The moving guide 150 is shaped as a pipe allowing for the passage of a cable of a number of twisted wires, so that it cannot be cut by a cutter, thereby preventing unauthorized entry.

When the moving guide 150 and the lattice unit 160 are installed, the lattice unit 160 is collapsed or unfolded along the moving guide 150. The coupling vertical rod 161 of the lattice unit 160 is fixed to the inside channel's window 130.

FIG. 2 is a partial perspective view of a security window before the inside channel's window 130 is installed to the window, seen from the inside of the building. As shown in FIG. 2, the coupling vertical rod 161 leftmost forms coupling holes 161*b* at the top and bottom portions on the front side. The frame 131 of the inside channel's window 130 forms coupling protrusions 132 on the right at locations of the top and bottom potions, corresponding to the coupling holes 161*b* of the coupling vertical rod 161. Each of the coupling protrusions 132 has a bent portion that is shaped as the letter 'L' bent in the lower direction.

When the moving guide 150 and the lattice unit 160 are installed to the sash 110, the coupling protrusions 132 of the inside channel's window 130 are hooked and locked to the coupling holes 161*a* of the coupling vertical rod 161. In general, in order to install the inside channel's window 130 to the sash 110, the top edge of the inside channel's window 130 is first fitted into the upper channel of the sash 110 and then the bottom edge is aligned and placed on the rail in the lower channel. Since the bottom of the inside channel's window 130 is placed on the rail in the lower channel of the sash 110 and the top of the inside channel's window 130 is inserted in the upper channel, the inside channel's window 130 is not removed from the sash 110.

When the security window according to the invention is installed to the window, the inside channel's window 130 and the lattice unit 160 are coupled to each other in such a way that: the inside channel's window 130 is lifted in order to fit the top edge into the upper channel of the sash 110; the coupling protrusions 132 with bent potions are inserted into the coupling holes 161*b* of the coupling vertical rod 161; the bottom edge is placed on the rail in the lower channel of the sash 110; and the bent portions of the coupling protrusions 132 are hooked into the coupling holes 161*b* of the coupling vertical rod 161.

When the inside channel's window 130 is installed to the sash 110, it may be difficult to align the coupling protrusions 132 of the inside channel's window 130 to the coupling holes 161*b* of the coupling vertical rod 161 of the lattice unit 160. The difficulty is resolved as follows. Referring to FIG. 5, when insert guide pieces 133 are installed to both sides of the coupling protrusions 132 of the inside channel's window 130, the coupling vertical rod 161 is guided the space therebetween, so that the protrusions 132 can be easily inserted into the coupling holes 161*b*.

After the inside channel's window 130 and the lattice unit 160 are coupled to each other, there may be an attempt to separate the inside channel's window 130 from the lattice unit 160 by lifting it, and this attempt is prevented as follows. Referring to FIG. 6, after the inside channel's window 130 is coupled to the sash 110, the lifting preventing unit 134 installed to the top of the inside channel's window 130 is rotated so that one end contacts the sash 110, thereby preventing the inside channel's window 130 from being lifted. Since the inside channel's window 130 is not separated from the sash 110 until it is lifted, it cannot be separated from the lattice unit 160. Although the embodiment of the invention describes the lifting preventing unit 134 based on a rotatable type of piece, it should be understood that the invention is not limited to the embodiment. It will be appreciated that the invention may also employ various types of pieces if they prevent the inside channel's window 130.

In a state where the inside channel's window 130 and the lattice unit 160 are coupled to each other, when the inside channel's window 130 is open as shown in FIG. 3, the vertical rods 161, 162 and 163 are spread out, with the links 164, blocking the opening of the window. Therefore, the structure can prevent unauthorized entry and children from falling out of the window. Meanwhile, when the inside channel's window 130 is closed as shown in FIG. 4, the vertical rods 161, 162 and 163 are collapsed so that the inside channel's window 130 can be completely shut.

As shown in FIGS. 2 and 3, the moving guide installation pieces 121 are fixed to the inside wall of the frame of the outside channel's window 120 by bolt, and those portions are always hidden by the frame 131 of the inside channel's window 130. Therefore, a person's hand or tools cannot access the bolt of the moving guide installation pieces 121 from the outside of the building. That is, the bolt cannot be loosened from the outside of the building.

Meanwhile, the security window is removed from the window from the inside of the building in such a way that: the lifting preventing unit 134 is unlocked; the inside channel's window 130 is lifted; and the coupling protrusions 132 of the inside channel's window 130 are separated from the coupling holes 161*b* of the coupling vertical rod 161 of the lattice unit 160. Since the security window can be separated from the inside of the building, it facilitates an emergency escape or a movement of objects.

Embodiment 2

Figure 7:
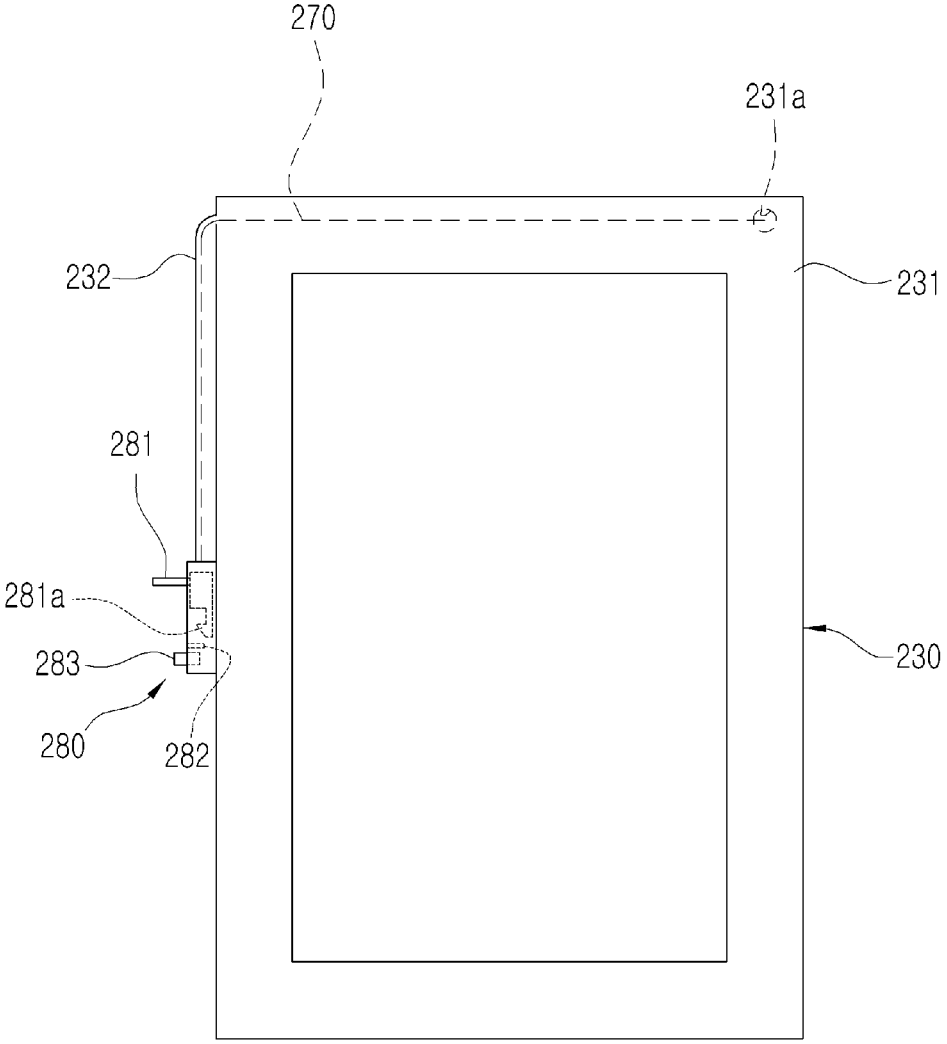
FIG. 7 is an elevation of an inside channel's window to which a lock and a pulling wire are installed, seen from the inside of the building, in a security window applied to a single window according to a second embodiment of the invention.
Figure 8:
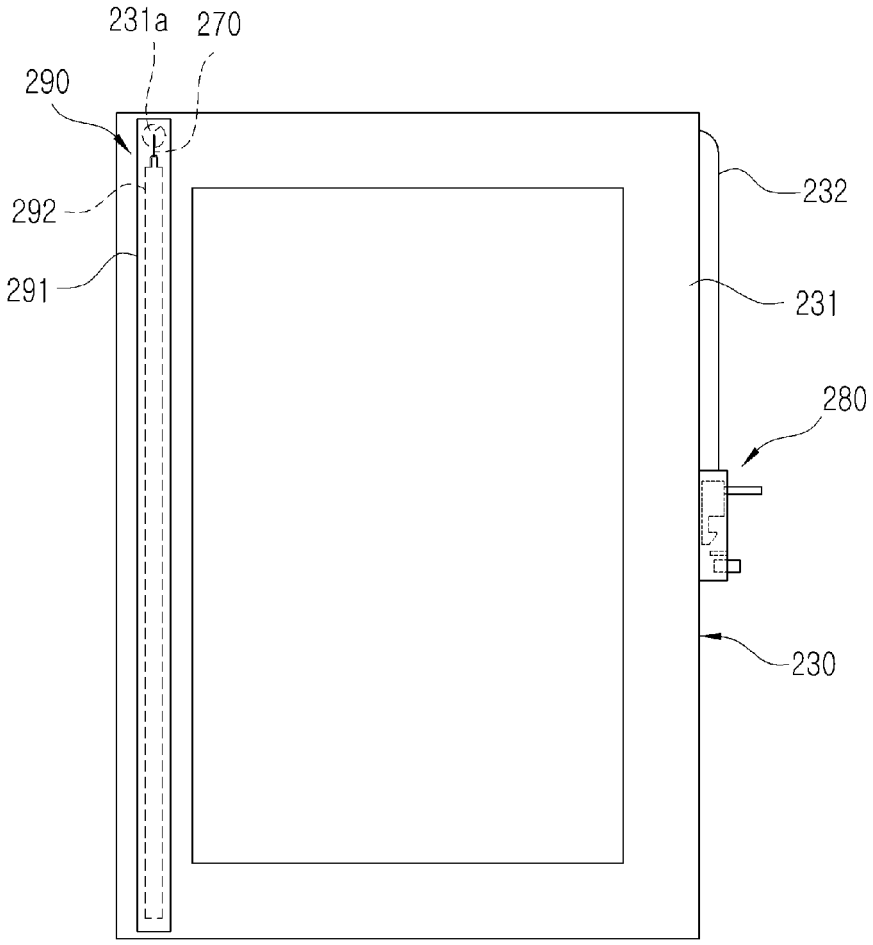
FIG. 8 is an elevation of an inside channel's window to which a fixing bar is installed, seen from the outside of the building, in a security window applied to a single window according to a second embodiment of the invention.
Figure 9:
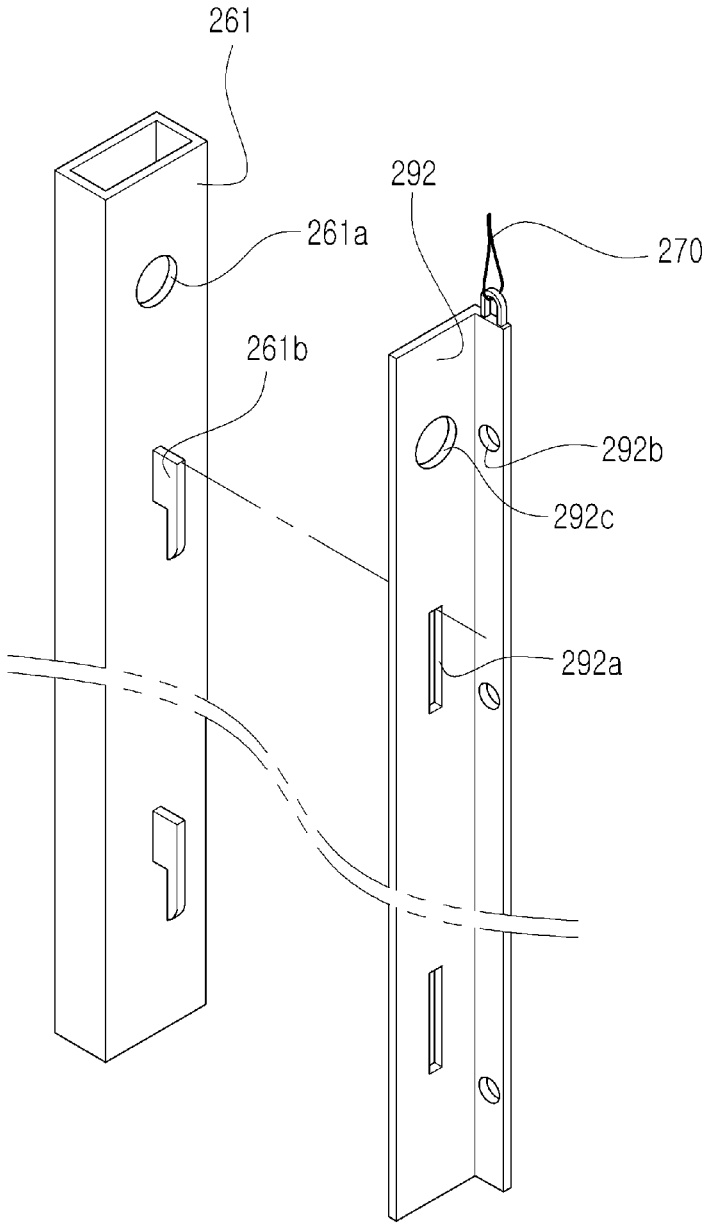
FIG. 9 is a perspective view of a lattice unit and a latching piece of a fixing bar in a security window applied to a single window according to a second embodiment of the invention.
Figure 10:
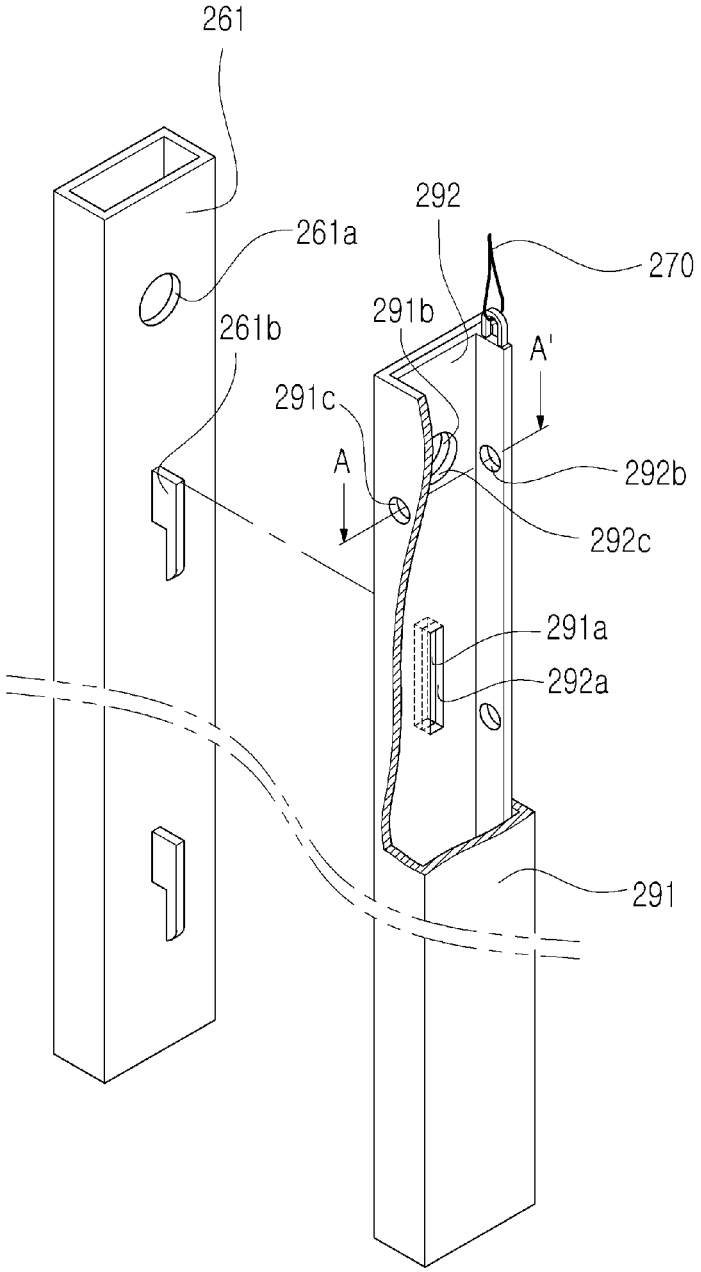
FIG. 10 is a partial perspective view of a lattice unit, a latching piece of a fixing bar, and a body in a security window applied to a single window according to a second embodiment of the invention.
Figure 11:
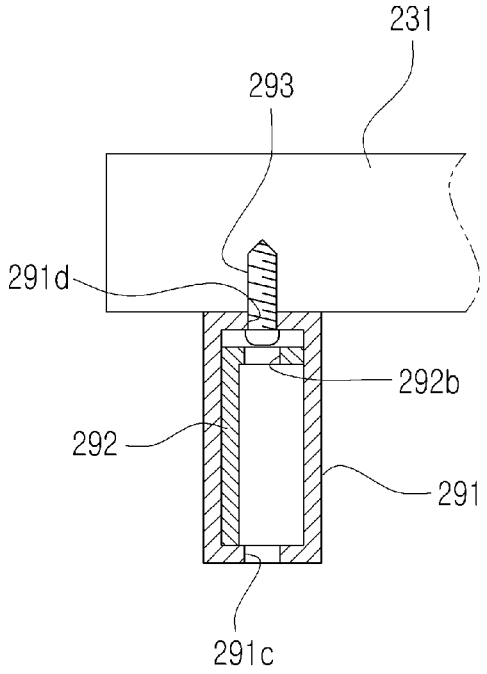
FIG. 11 is a cross-sectional view of FIG. 10, taken along line A-A'.
Figure 12:
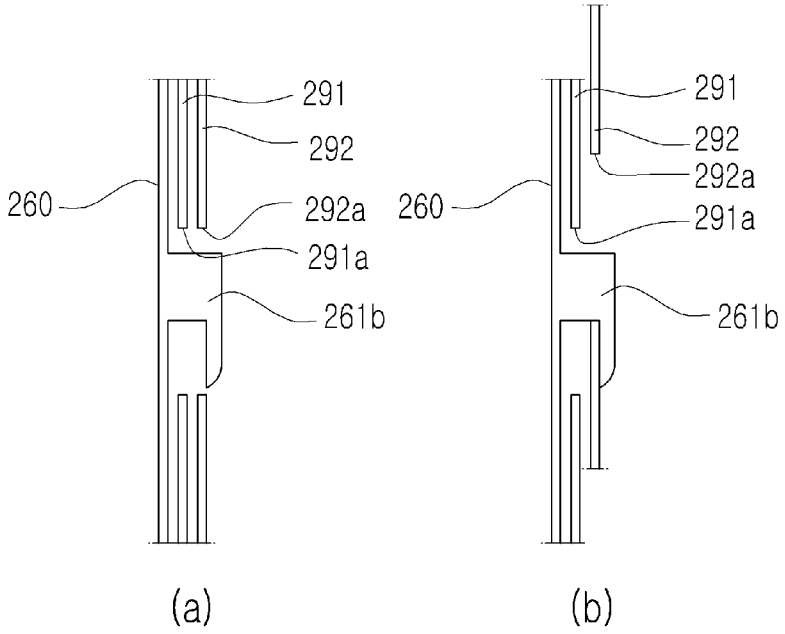
FIG. 12 is cross-sectional views showing states where a locking piece is coupled to and released from a body of a fixing bar installed to the inside channel's window in a security window applied to a single window according to a second embodiment of the invention.
Figure 13:
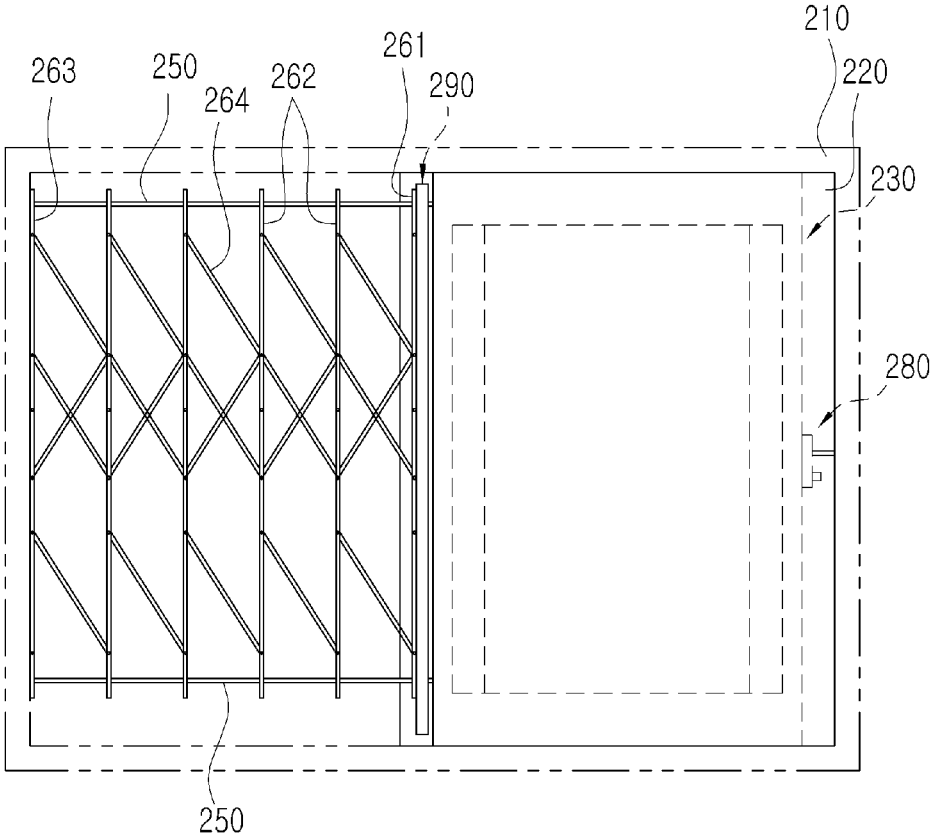
FIG. 13 is an elevation view of a window to which a security window applied to a single window is installed, in a state where the inside channel's window is open, seen from the outside of the building, according to a second embodiment of the invention.
Figure 14:
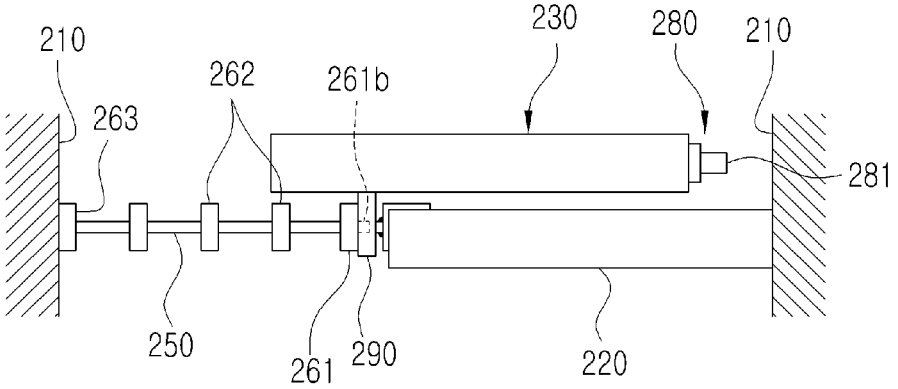
FIG. 14 is a top view of FIG. 13, describing the state in concept.
Figure 15:
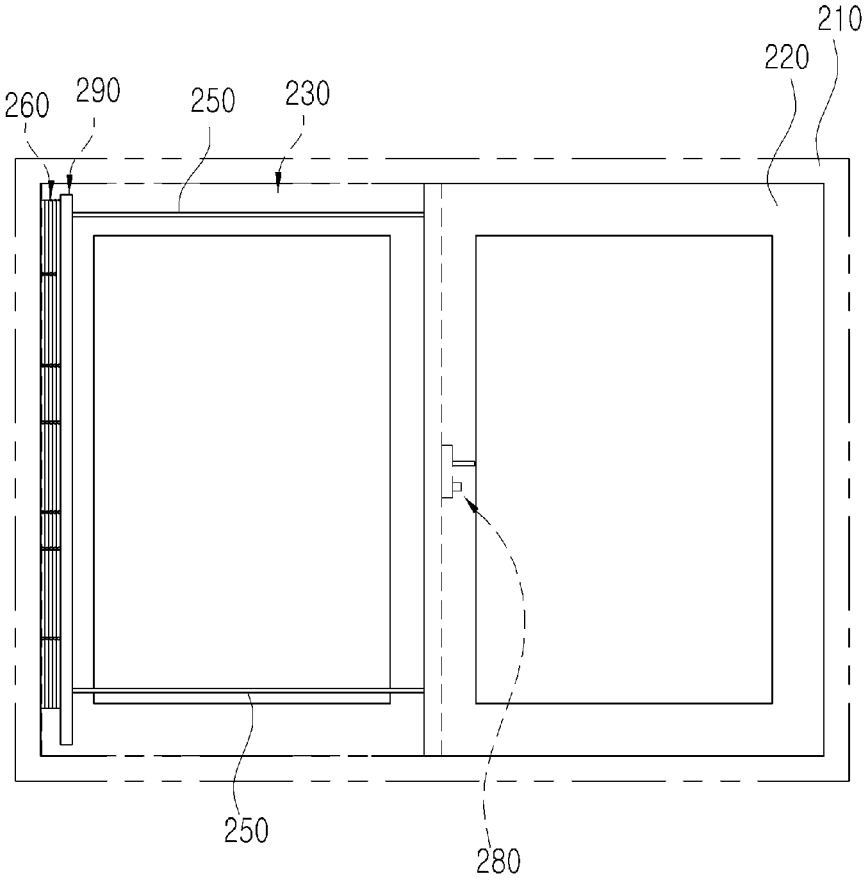
FIG. 15 is an elevation view of a window to which a security window applied to a single window is installed, in a state where the inside channel's window is closed, seen from the outside of the building, according to a second embodiment of the invention.
Figure 16:
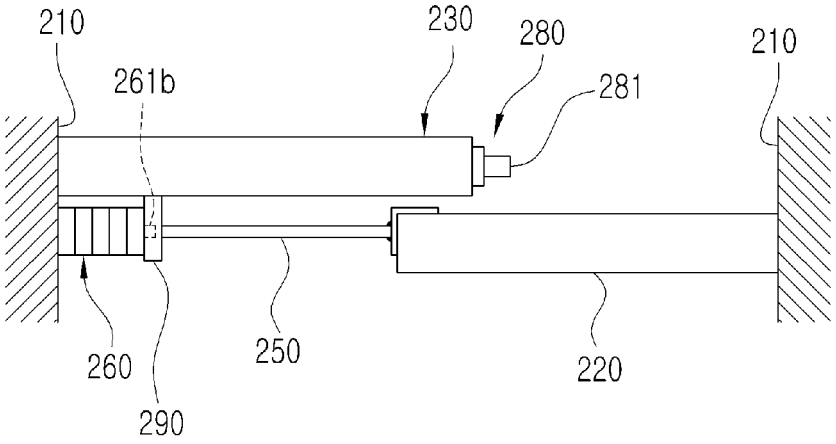
FIG. 16 is a top view of FIG. 15, describing the state in concept.

FIG. 7 is an elevation of an inside channel's window to which a lock and a pulling wire are installed, seen from the inside of the building, in a security window applied to a single window (hereafter called a security window), according to a second embodiment of the invention. FIG. 8 is an elevation of an inside channel's window to which a fixing bar is installed, seen from the outside of the building, in a security window according to a second embodiment of the invention. FIG. 9 is a perspective view of a lattice unit and a latching piece of a fixing bar in a security window according to a second embodiment of the invention. FIG. 10 is a partial perspective view of a lattice unit, a latching piece of a fixing bar, and a body in a security window according to a second embodiment of the invention. FIG. 11 is a cross-sectional view of FIG. 10, taken along line A-A'. FIG. 12 is cross-sectional views showing states where a locking piece is coupled to and released from a body of a fixing bar installed to the inside channel's window in a security window according to a second embodiment of the invention. FIG. 13 is an elevation view of a window to which a security window is installed, in a state where the inside channel's window is open, seen from the outside of the building, according to a second embodiment of the invention. FIG. 14 is a top view of FIG. 13, describing the state in concept. FIG. 15 is an elevation view of a window to which a security window is installed, in a state where the inside channel's window is closed, seen from the outside of the building, according to a second embodiment of the invention. FIG. 16 is atop view of FIG. 15, describing the state in concept.

Referring to FIG. 7 seen from the inside of the building, the inside channel's window 230 installs a lock 280 for controlling a pulling wire 270 to the left of the frame 231, and also a fixing bar 290 to the opposite. As shown in FIG. 8 seen from the outside of the building, the inside channel's window 230 installs the fixing bar 290 including a locking piece 192 to the left.

The lock 280 includes a switch 281, a latching protrusion 282, and an unlatching button 283. The switch 281 connects the top to the pulling wire 270 and the bottom to the latching piece 281*a*. Since the latching protrusion 282 is fixed to the lower portion of the switch 281, when the switch 281 is lowered, the latching piece 281*a* of the switch 281 is latched to the latching protrusion 282, thereby preventing the switch 281 from being lifted up. Meanwhile, the unlatching button 283 pushes and unlocks the latching piece 281*a* of the switch 281 from the latching protrusion 282.

The pulling wire 270 fixes one end to the switch 281 of the lock 280. The pulling wire 270 extends, along the inside space of the cover 232 installed to the frame 231, through the through-hole 231*a* formed on the outer surface, opposite the frame 231 of the inside channel's window 230, and is connected to a locking piece 292 of the fixing bar 290.

The fixing bar 290 includes a body 291, fixed to the outside wall of the frame 231 of the inside channel's window 230, and a locking piece 292 movable up and down in a certain distance in the body 291. The body 291 forms coupling holes 291*a*, as shown in FIG. 10, for receiving the coupling protrusions 261*a* of the lattice unit 160, at the upper and lower portions, on the left, on FIG. 8. The body 291 is fixed to the frame 231 of the inside channel's window 230 by bolts 291*d*.

Referring to FIG. 9, the locking piece 292 is shaped as the letter 'L.' The locking piece 292 forms locking holes 292*a* at the upper and lower portions on the left wall and bolt guide holes 292*b* on the back wall. Referring the locking piece 292 and the body 291 shown in FIG. 10, the body 291 forms the bolt entry portion 291*c* and the bold fixing portion 291*d* on the front and back walls respectively, corresponding to the bolt guide holes 292*b* of the locking piece 292.

Referring to FIG. 11 showing a cross-sectional view of FIG. 10, taken along line A-A', a screwdriver passes, from the inside of the building, to a bolt 293 through the bolt entry portion 291*c* of the front wall of the body 291, the bolt guide hole 292*b* of the locking piece 292, and the bolt fixing portion 291*d* of the back wall of the body 291, in order, and screws or unscrews the bold 293.

When the locking piece 292 is unlocked and loosened (or lowered), the bolt guide hole 292*b* of the locking piece 292 faces the bolt fixing portion 291*d* of the body 291. A screwdriver enters the bolt entry portion 291*c* of the body 291 and screws or unscrews the bolt 293. On the contrary, when the locking piece 292 is locked (or lifted), the bolt guide hole 292*b* of the locking piece 292 is separated from the bolt fixing portion 291*d* of the body 291. In that case, although the screwdriver passes through the bolt entry portion 291*c* of the body 291, since the bolt fixing portion 291*d* of the locking piece 292 is hidden, it cannot unscrew the bolt in the bolt fixing portion 291.

To resolve the problem, the locking piece 292 according to the embodiment of the invention is produced in such a way that the cross-section is shaped as the letter 'L.' That is, one part of the L-bent portion of the locking piece 292 faces the coupling hole 291*a* of the body 291 and binds the coupling protrusion 261*b*. The other part covers the bolt fixing portion 291*d* of the back wall of the body 291.

Like Embodiment 1, Embodiment 2 is implemented in such a way that: the lattice unit 260 includes a coupling vertical rod 261, intermediate vertical rods 262, and a fixed vertical rod 263 and links 264. Each of the vertical rods 261, 262, and 263 forms insertion holes a 261*a* at the top and bottom portions through which the moving guide 250 is fitted. One end of the moving guide 250 is fixed to the sash 210 and the other end is fixed to the outside channel's window 220 through the inserting hole 291*b* of the body 291 and the insertion hole c 292*c* of the locking piece 292. The fixed vertical rod 263 is fixed to the sash 210. The coupling vertical rod 261 forms coupling protrusions 261*b* on the side wall to be inserted into the fixing bar 290.

As shown in FIG. 10 and diagram (a) of FIG. 12, in a state where the coupling protrusion 261*b* of the coupling vertical rod 261 is inserted through the coupling hole 291*a* of the body 291 of the fixing bar 290 and the locking hole 292*a* of the locking piece 292, when the switch 281 of the lock 280 is pulled down to pull the pulling wire 270, the locking piece 292 is lifted up, so that the L-bent portion of the coupling protrusion 261*b* is locked into the locking hole 292*a* of the locking piece 292 and bound thereto as shown in diagram (b) of FIG. 12. Therefore, the coupling vertical rod 261 is coupled to the fixing bar 290 installed to the inside channel's window 230.

Meanwhile, when the unlatching button 283 of the lock 280 is pressed, the rear end of the unlatching button 283 pushes the latching piece 281*a* of the switch 281, thereby unlocking the switch 281. Therefore, the pulling wire 270 is pulled by the weight of the locking piece 292 and the switch 281 is lifted up. As shown in diagram (a) of FIG. 12, the locking piece 292 is lowered, thereby unlocking the coupling protrusion 261*b* of the locking piece 292. In that case, the coupling vertical rod 261 of the lattice unit 260 is separated from the fixing bar 290 of the inside channel's window 230.

After the installation of the security window according to the embodiment of the invention, referring to FIG. 13 showing an elevation view of the security window seen from the outside of the building and FIG. 14 showing the top view, when the inside channel's window 230 is open in a state where the coupling vertical rod 261 is coupled to the fixing bar 290 as the switch 281 of the lock 280 is pulled, the vertical rods 261, 262 and 263 of the lattice unit 260 are spread out on the opening of the window with the links 264 connecting the vertical rods.

On the contrary, as shown in FIG. 15 showing an elevation view of the security window seen from the outside of the building and FIG. 16 showing the top view, when the inside channel's window 230 is closed, the vertical rods 261, 262 and 263 of the lattice unit 260 are closely collapsed, so that the inside channel's window 230 is completely closed.

The embodiment is implemented in such a way that the coupling vertical rod 261 of the lattice unit 260 is coupled to or separated from the fixing bar 290 of the inside channel's window 230 by operating the switch 281 of the lock 280. That is, after the coupling protrusion 261*b* of the lattice unit 260 is inserted through the coupling hole 291*a* of the fixing bar 290 and the locking hole 292*a*, when the switch 281 is lowered and fixed so that the latching piece 281*a* is locked to the latching protrusion 282, the lattice unit 260 is spread out or collapsed as the inside channel's window 230 is open or closed, thereby preventing unauthorized entry or falls out of the window. When the fixing bar 290 and the lattice unit 260 are disconnected to each other as the unlatching button 283 of the lock 280 is pushed, although the inside channel's window 230 is open, the lattice unit 260 is not spread out, so that the opening of the window allows for a movement of objects and an emergency escape.

Although the inside channel's window 230 is open while the lattice unit 260 is fixed to the inside channel's window 230, a person's hand cannot extend to reach the lock 280 installed to the end opposite the open space and thus cannot operate the switch 281, from the outside of the building. In addition, when the locking piece 292 is lifted up in a state the switch 281 is locked, the bolt 293 fixing the body 291 to the frame 231 of the inside channel's window 230 is completely hidden by the locking piece 292, and thus cannot be loosened. Therefore, the security window cannot be removed from the window from the outside of the building.

Embodiment 3

Figure 17:
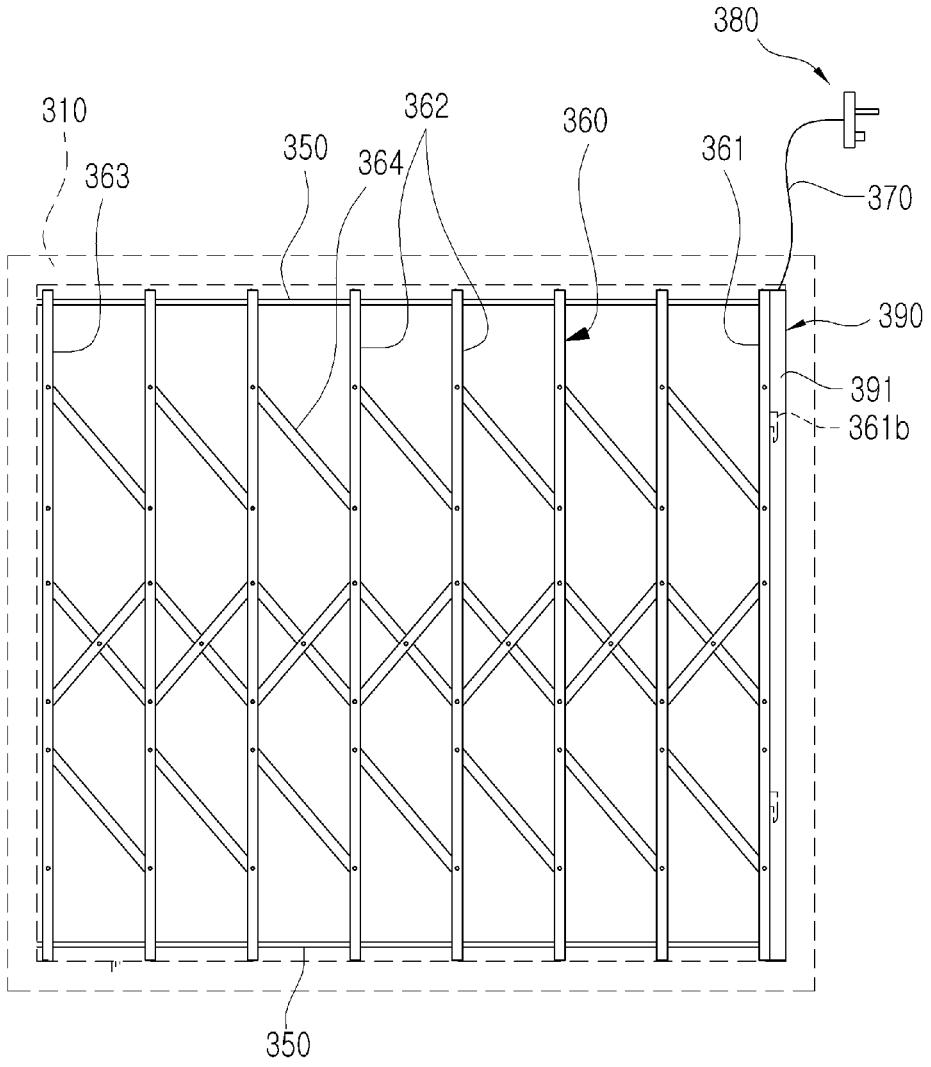
FIG. 17 an elevation view of a security window applied to a single window, installed to a sash, according to a third embodiment of the invention.

FIG. 17 an elevation view of a security window applied to a single window (hereafter called a security window), installed to a sash, according to a third embodiment of the invention.

The embodiment is a security window that is installed to a sash 310 to cover the opening of a window, regardless of the outside channel's window or the inside channel's window.

Referring to FIG. 17, moving guides 350 are installed to the top and bottom portion of the sash 310, extending in the horizontal direction of the opening of the window. A lattice unit 360 is movably installed to the moving guides 350. The lattice unit 360 includes a coupling vertical rod 361, intermediate vertical rods 362, fixed vertical rod 363 and links 364. When seen from FIG. 7, the fixed vertical rod 363 is fixed to the left of the sash 310. The coupling vertical rod 361 forms a coupling protrusion 361*b* on the right wall. The coupling protrusion 361*b* of the coupling vertical rod 361 is inserted into a locking piece (not shown) and a body 391 of a fixing bar 390 fixed to the right of the sash 310. The coupling protrusion 361*b* is bound to or unlocked in the same principle as the fixing bar 290 of Embodiment 2 is operated. That is, the coupling protrusion 361*b* is bounded in such a way that the pulling wire 370 is pulled by operating the lock 380 and thus the locking piece (not shown) is lifted up. The coupling protrusion 361*b* is also unlocked in such a way that the locking piece (not shown) is lowered by pushing the unlatching button of the lock 380.

Since the security window according to the embodiment of the invention is installed to the sash 310 of a window in such a way that the lattice unit 360 covers the opening of the window regardless of whether the inside channel's window is opened or closed, it can prevent unauthorized entry and falls out of the window. In addition, since the lattice unit 360 is separated from the fixing bar 390 by pushing the unlatching button of the lock 380 if necessary, the opening of the window allows for a movement of objects and an emergency escape if the lattice unit 360 is collapsed.

When the lock 380 is installed to a location apart from the sash 310, it cannot be operated by a person from the outside of the building.

Embodiment 4

Figure 18:
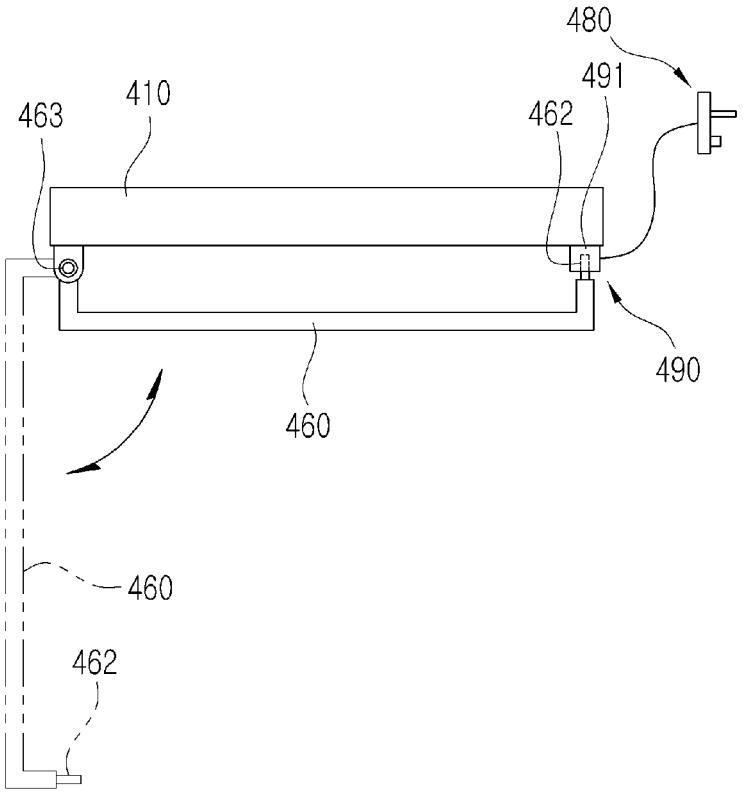
FIG. 18 is an elevation view of a security window applied to a single window, installed to a sash, according to a fourth embodiment of the invention.

FIG. 18 is an elevation view of a security window applied to a single window (hereafter called a security window), installed to a sash, according to a fourth embodiment of the invention.

The embodiment is a security window that is installed to a sash 410 to cover the opening of a window. Unlike the collapsed type lattice unit of Embodiment 3, the lattice-fixed security window 460 is installed to the sash 410 in such a way that one end is pivotally fixed to one side of the sash 410, as a hinge 463. The lattice-fixed security window 460 forms a coupling protrusion 462 on the other end, protruded to the sash 410. A body 491 of a fixing bar 490, operated in the same principle as Embodiment 2, is fixed to the sash 410. When the coupling protrusion 462 is inserted into the fixing bar 490 and a switch of the lock 480 is lowered, the pulling wire lifts the locking piece, so that the lattice-fixed security window 460 is fixed to the fixing bar 490, in the same way as Embodiment 2.

When the lock 480 is installed to a location apart from the sash 410, it cannot be operated by a person from the outside of the building. When the unlatching button of the lock 480 is pushed from the inside of the building, the lattice-fixed security window 460 is separated from the fixing bar 490 and rotated to leave the opening of the window open.

As described above, the security window according to the invention is applied to an existing single window and blocks the opening of the window, thereby preventing unauthorized entry and falls out of the window. The security window can be separated from the window from the inside of the building, if necessary, it can allow for a movement of an object or an emergency escape through the opening of the window. Meanwhile, since the security window cannot be removed from the window from the outside of the building, it can prevent any intrusion by persons with malicious intent from the beginning.

Although exemplary embodiments of the invention have been described in detail above, it should be understood that many variations and modifications of the basic inventive concept herein described, which may be apparent to those skilled in the art, will still fall within the spirit and scope of the exemplary embodiments of the invention as defined in the appended claims.

What is claimed is:

1. A security window applied to a single window comprising:

moving guides fixedly installed between one side of an outside channel's window and a sash at a location facing the outside channel's window;

a lattice unit with a number of vertical rods, wherein: the vertical rods are connected to each other by links, form insertion holes to which the moving guides are inserted, and are collapsed or spread out along the moving guides;

a fixing bar including a body and a locking piece, wherein: the body is installed to one side of an inside channel's window and forms a coupling hole through which a coupling protrusion of the lattice unit passes; and the locking piece connects to one end of a pulling wire, is movable up and down, and forms a locking hole at a location corresponding to the coupling hole of the body; and a lock for binding the coupling protrusion of the lattice unit as the locking piece is lifted up by operating a switch connected to the other end of the pulling wire or for unlocking the coupling protrusion by lowering the locking piece, wherein the coupling protrusion of the lattice unit is shaped to have a portion bent in the lower direction; and the locking piece of the fixing bar is shaped to have a portion bent as the letter 'L' in cross-section, wherein: the locking hole facing the coupling hole of the body is formed on one side wall of the bent portion of the locking piece; and when the locking piece is lifted up by operating the lock, the bent portion of the coupling protrusion is bound into the locking hole.

2. A security window applied to a single window comprising:

moving guides fixedly installed between one side of an outside channel's window and a sash at a location facing the outside channel's window;

a lattice unit with a number of vertical rods, wherein: the vertical rods are connected to each other by links, form insertion holes to which the moving guides are inserted, and are collapsed or spread out along the moving guides;

a fixing bar including a body and a locking piece, wherein: the body is installed to one side of an inside channel's window and forms a coupling hole through which a coupling protrusion of the lattice unit passes; and the locking piece connects to one end of a pulling wire, is movable up and down, and forms a locking hole at a location corresponding to the coupling hole of the body; and a lock for binding the coupling protrusion of the lattice unit as the locking piece is lifted up by operating a switch connected to the other end of the pulling wire or for unlocking the coupling protrusion by lowering the locking piece, wherein: the body of the fixing bar is fixed to the inside channel's window by a bolt; a bolt guide hole through which that bolt passes is formed on the other side wall of the bent portion of the locking piece of the fixing bar; when the locking piece is lowered, the bolt guide hole faces the bolt, so that the bolt is loosened; and when the locking piece is lifted, the bolt is hidden, so that the bolt is not loosened.

3. A security window applied to a single window comprising:

moving guides extended and installed between both sides of a sash;

a lattice unit with a number of vertical rods, wherein: the vertical rods are connected to each other by links, form insertion holes to which the moving guides are inserted, and are collapsed or spread out along the moving guides;

a fixing bar including a body and a locking piece, wherein: the body is installed to the other end of the sash and forms a coupling hole through which a coupling protrusion of the lattice unit passes; and the locking piece connects to one end of a pulling wire, is movable up and down, and forms a locking hole at a location corresponding to the coupling hole of the body; and a lock for binding the coupling protrusion of the lattice unit as the locking piece is lifted up by operating a switch connected to the other end of the pulling wire or for unlocking the coupling protrusion by lowering the locking piece, wherein: the coupling protrusion of the lattice unit is shaped to have a portion bent in the lower direction; and the locking piece of the fixing bar is shaped to have a portion bent as the letter 'L' in cross-section, wherein: the locking hole facing the coupling hole of the body is formed on one side wall of the bent portion of the locking piece; and when the locking piece is lifted up by operating the lock, the bent portion of the coupling protrusion is bound into the locking hole.

* * * * *